United States Patent [19]

Ellis, Jr.

[11] 4,315,266

[45] Feb. 9, 1982

[54] SPIRAL SLOTTED PHASED ANTENNA ARRAY

[76] Inventor: Robert A. Frosch, Administrator of the National Aeronautics and Space Administration, with respect to an invention of Haynes Ellis, Jr., Chino, Calif.

[21] Appl. No.: 172,099

[22] Filed: Jul. 25, 1980

[51] Int. Cl.[3] ..... H01Q 1/36

[52] U.S. Cl. ..... 343/895; 343/789

[58] Field of Search ..... 343/895, 854, 789, 769, 343/767

[56] References Cited

U.S. PATENT DOCUMENTS 2,863,145 12/1958 Turner ..... 343/895

3,344,425 9/1967 Shelton, Jr. ..... 343/895

*Primary Examiner*—David K. Moore

*Attorney, Agent, or Firm*—Edward K. Fein; John R. Manning; Marvin F. Matthews

[57] ABSTRACT

A flush mounting, cavity-backed, dual orthogonal slot antenna in which improved radiation pattern characteristics are obtained by making the spiral slot pattern elliptical in the aperture plane. A cavity (11) and a flanged aperture plate (11*a*) are shown in which one slot pair (12 and 13) is orthogonal with respect to another slot pair (14 and 15) within the aperture plate (11*a*). Coaxial split-tube baluns (12*a* and 14*a*) are used to drive the junctions between corresponding slot pairs. Optional cavity dielectric (18) is provided and a drive coupling arrangement includes a four port comparator hybrid (30) having ≦ and Δ ports (17 and 16) respectively, for alternate excitation to produce a single lobe or a double lobe pattern with null. Switching apparatus is provided to connect a common terminal (26) to either of the ports (17 or 16).

10 Claims, 8 Drawing Figures

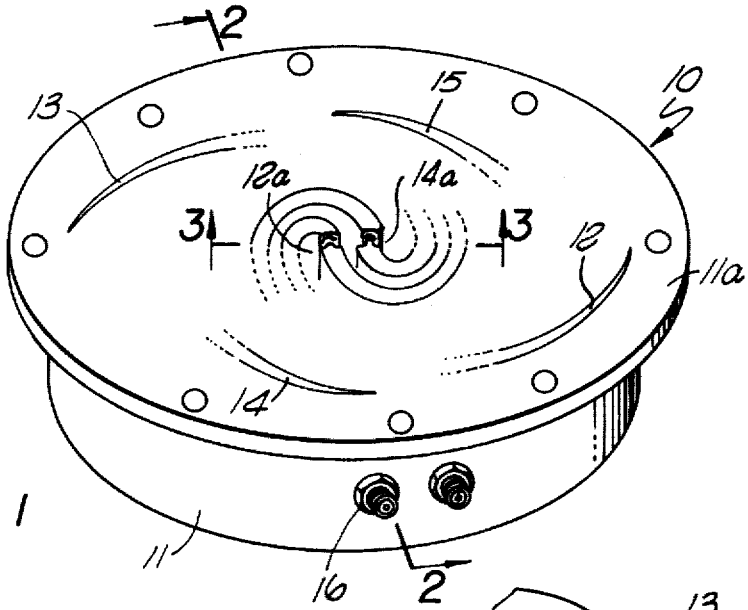
FIG. 1
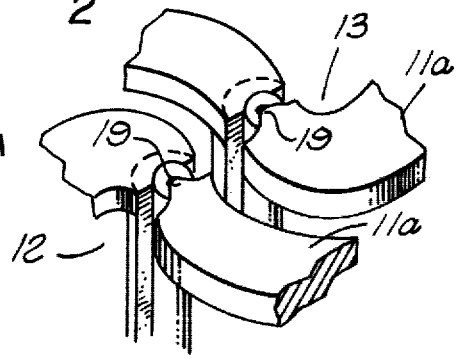
FIG. 1A
FIG. 2
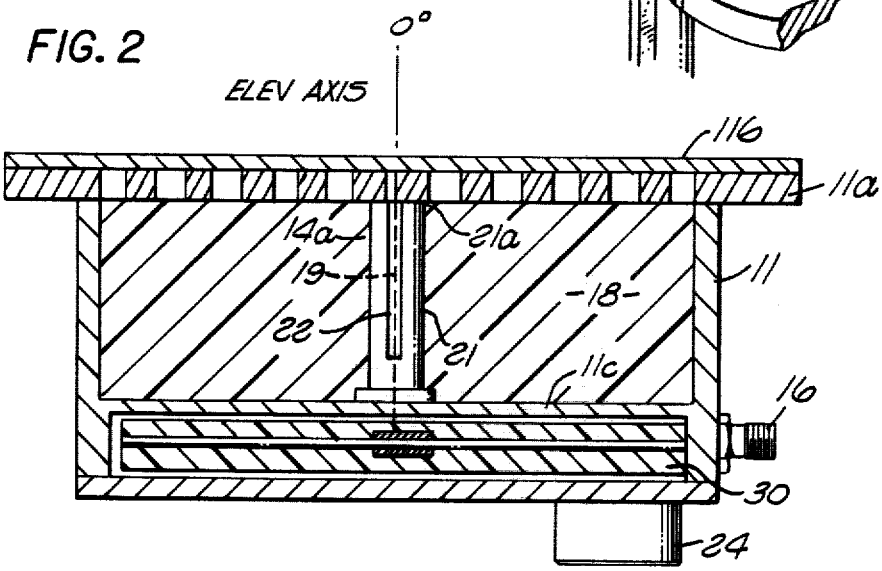

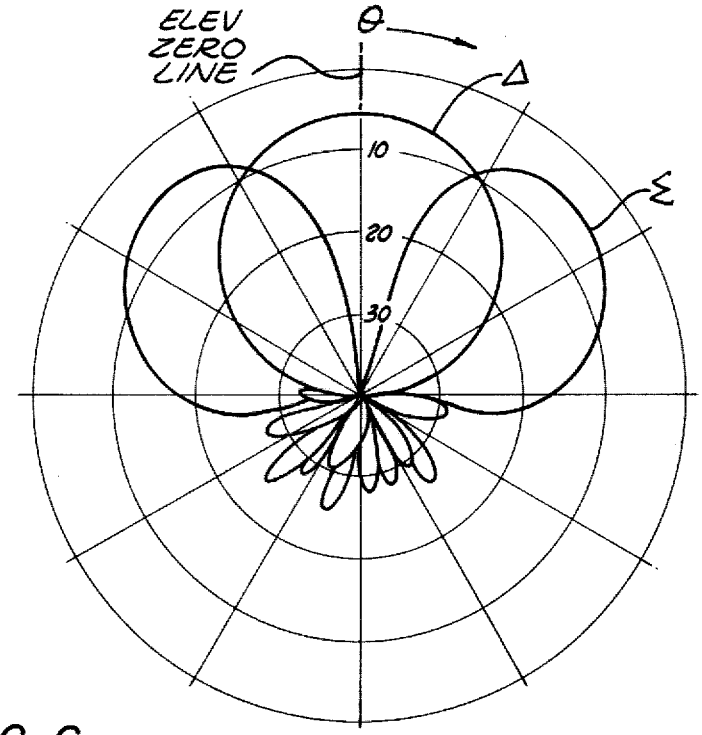
FIG. 6 ELEVATION PLANE
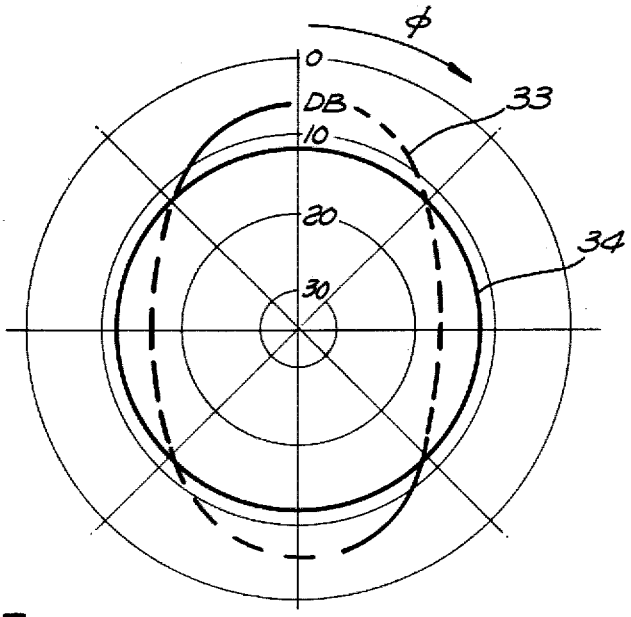
FIG. 7 AZIMUTH PLANE

SPIRAL SLOTTED PHASED ANTENNA ARRAY

DESCRIPTION

ORIGIN OF THE INVENTION

The invention described herein was made in the performance of work under a NASA Contract and is subject to the provisions of Section 305 of The National Aeronautics and Space Act of 1958, Public Law 85-568 (72 Stat. 435; U.S.C. 2457).

TECHNICAL FIELD

My invention relates generally to electromagnetic antennas and more specifically to flush mounted antennas for aircraft and space vehicles for such functions as communications and the like, most particularly for operation in the microwave bands.

In high performance aircraft and reentry spacecraft the problems of aerodynamic load and friction heating preclude the employment of any antenna system which wholly or partly protrudes beyond the skin surface of such high performance air/space vehicles.

The usual frequencies of operation are very high and therefore compact structures are possible, even where special radiation patterns are required. The so-called cavity-backing concept has been used in the prior art and is also used in the invention because of the opportunity for effecting radiation reenforcement due to cavity resonance.

BACKGROUND ART

In the prior art, various approaches have been taken for the implementation of flush-mounted antennas for various end uses. Some of these are adapted for flush mounting in air/space vehicles, even though deficient in certain important aspects, vis-a-vis the invention herein disclosed and described.

Cavity-backed antennas for the air/space vehicle application are particularly attractive because they readily afford flush mounting, consequently the pertinent prior art comprises cavity-backed configurations. Moreover, spiral antennas per se are known to have relatively broad beam characteristics normal to the plane of the spiral. Cavity backing of a spiral antenna is known to provide increased directional sensitivity and a favorable electrical combination otherwise, since the spiral elements are, in a sense folded, thereby permitting them to be electrically relatively long within a correspondingly small aperture.

Arrays of spiral antennas each with resonant cavity backing have been used for direction finding. Those spirals are spaced about the points of a compass and lie in vertical planes. Frequently no particular effort to compact such arrays is required, however, in U.S. Pat. No. 4,143,380 an arrangement is described in which the spirals are disposed about a cylindrical surface and share a common resonant chamber of annular cross-section within the cylindrical surface. The combination of the aforementioned Pat. No. 4,143,380 is of interest because of its teachings in respect to compaction of cavity-backed spiral antennas, but obviously it is not applicable for flush mounting, at the skin surface of an air/space vehicle.

U.S. Pat. No. 4,032,921 describes a cavity-backed spiral antenna which would readily be flush mounted, however the spiral is filamentary in nature and, even if well covered by a radome, is subject to damage from air friction heating.

A retro-directive, cavity-backed assembly of spiral radiators is shown in U.S. Pat. No. 3,508,269. Tunnel diodes are connected to provide discontinuities in the associated transmission line to cause reflection of signal energy toward the feed assembly. Etched circuit techniques are employed to produce the spiral elements from copper clad dielectric sheets. Essentially the same vulnerability to air friction heating as noted in connection with U.S. Pat. No. 4,032,921 can be attributed to this configuration.

U.S. Pat. No. 3,568,206 discloses a square filamentary sprial antenna within a square cavity. Significance is attached to a slot formed by the clearance between the cavity sidewalls and the perimeter of the spiral. Again the same vulnerability to air friction heating attaches to this device as aforementioned.

U.S. Pat. No. 4,015,264 depicts a cavity-backed spiral antenna, in which a plurality of resistively loaded monopoles are disposed within the cavity for broadbanding purposes, without overall size increase. Yet again, the filamentary spiral of this antenna would be in a plane parallel and close to the plane of the vehicle skin surface, with the result that it too would be very subject to air friction heating. Such heating produces very high localized temperatures and filamentary elements of any kind can thereby be subject to severe damage or even destruction.

The known prior art, including the teachings of the aforementioned U.S. patents do not provide truly advantageous structures for the purpose of the present invention.

DISCLOSURE OF THE INVENTION

In consideration of the state of the prior art and the limitations thereof, it may be said to have been the general object of the invention to provide an inexpensive thermal load resistant, flush mounting, cavity-backed compact antenna for air/space vehicle use. It was also desired to provide circular polarization and alternative radiation patterns as a function of excitation control. The details of such an excitation control for the purpose of radiation pattern selection will be evident as this description proceeds.

The radiating elements comprise a pair of collocated center-fed, interleaved, spiral slots in the aperture plane. The centers of the two slots are adjacent, one on either side of the center of the cavity. The slots are cut through a conductive aperture plate, the latter forming the external face of the cavity. At the center feed point of each slot, a balanced feed assembly is presented and each of these center points is fed from a split-tube coaxial balun. Both coaxial baluns extend through the cavity and through a second side thereof parallel to the aforementioned aperture plate. Beyond this second side, a comparator hybrid is instrumented in stripline medium, for example, although not necessarily in that medium. The four port comparator hybrid, a known device per se, has two output ports (sum and difference ports). Switching means are included so that the sum ($\Sigma$) or difference ($\Delta$) port of the comparator hybrid may be selectively excited to choose a sum or difference radiation pattern. The hybrid output ports each feed one of the slot centers through the corresponding balun.

The spiralled slots cover a pattern in the aperture plate which is elliptical, the reason for this being the control of the radiation pattern.

The foregoing and other aspects of the invention will be more fully explained as this specification proceeds.

BRIEF DESCRIPTION OF THE DRAWINGS

FIG. 1 is a perspective view of a typical antenna assembly according to the invention from the aperture surface thereof;

FIG. 1*a* is an expanded view of the center portion of FIG. 1;

FIG. 2 is a sectional view taken from FIG. 1 as indicated;

FIG. 6 is an elevation plane radiation pattern for the invention operated in accordance with arrangement of FIG. 5; and FIG. 7 in the corresponding azimuth radiation pattern for the same operation.

BEST MODE FOR CARRYING OUT THE INVENTION

Figure 3:
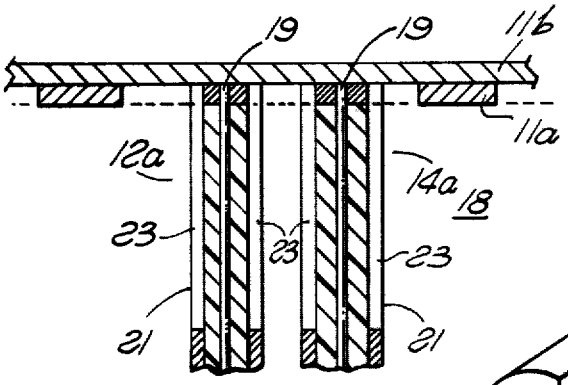
FIG. 3 is a partial sectional view taken orthogonally as compared to FIG. 2 showing the central area and the two split-tube baluns.

Referring now to FIG. 1, a cavity backed, dual orthogonal spiral-slot antenna is depicted, having a conductive cavity enclosure 11 with a flanged aperture plate 11*a*. The slots are cut through the aperture plate 11*a* so that they communicate with the interior of the cavity. One slot comprises the pair 12 and 13, these being the halves of one slot fed at its center 12*a*. Similarly, the slot halves 14 and 15 comprise the other slot, fed at center point 14*a*. It is helpful to think of the slots as developed into a spiral pattern from a turnstile configuration in which two center-fed slots are placed orthogonally and their ends then wrapped counterclockwise (as viewed in FIG. 1) while maintaining a predetermined radial spacing. It will be realized that each portion of a given slot lies between slots of the orthogonal slot pair and it is to be noted that this orthogonality continues throughout their spiral trajectories the overall slot pattern fitting into an elliptical outline backed by an elliptical cavity.

The expanded view of the center of FIG. 1 shown in FIG. 1*a* shows the shape of the web of 11*a* at the point of feed. The coaxial balun center conductor 19 connects to this projection at the point designated 19 on FIG. 1*a*. The coaxial balun outer conductor is connected to the web of 11*a* on the other side of the slot, and accordingly the slot itself is fed from a corresponding coaxial balun.

Figure 4:
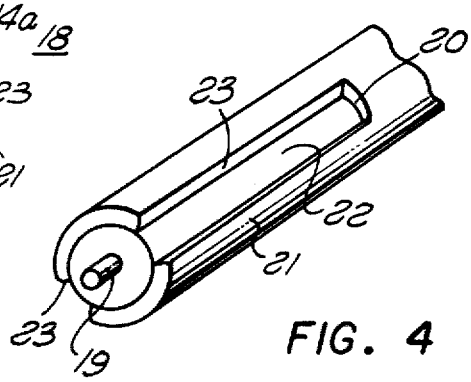
FIG. 4 is a detail in perspective showing the construction of the split-tube baluns.

Considering also the sectional view of FIG. 2 and also FIG. 4 at this time, one of the baluns 14*a* according to FIG. 4 will be seen in FIG. 2. This split-tube balun, being known per se, can be designed for the impedance conditions at the conjunction (interface) of each slot pair. In FIG. 2, balun 14*a* is shown passing through the cavity from the aperture plate, its center conductor 19 being connected to the metal web defining one side of the corresponding slot and the outside conductor 23 of the coaxial balun being connected to the metal web defining the other side of the same slot at the same location. The balun slot to a depth at 20 of one quarter wavelength from the slot connection splits the coaxial outer conductor into two portions 21 and 23, as illustrated in FIG. 2, avoiding interference with the connection of the center conductor 19 as it connects to the slot wall. The conductive abuttment 21*a* (FIG. 2) does not "short out" the coaxial balun center conductor, since the quarter-wavelength of the balun outer conductor halves gives rise to the high impedance point at 21*a*. The dielectric 22 in the baluns is conventional and can be selected from materials suitable at the frequency of operation.

FIG. 3 is self-explanatory and depicts the two baluns 12 and 14*a* as would be expected from FIG. 1. If the baluns are designed for 50 ohm characteristic impedance, the slot impedance can be approximately 120 ohms (70 ohms at the balun connection). Some design freedom obviously exists for modification of slot center-to-center radial spacing to provide a different slot impedance if desired, however the values given above are typical. The width of the slots is not critical but may conveniently be approximately equal to one half of the adjacent slot center-to-center radial spacing.

In FIG. 2, a radome 11*b* is shown over the aperture plate 11*a*, but was omitted from FIG. 1 for clarity. It will be understood that the center conductors 19 of the baluns proceed through the cavity 11*c* to connect to the appropriate strip conductors (branch ports) of the hybrid 30 while the outer conductors of the baluns connect to cavity wall 11*c*. The depth of the cavity i.e. the spacing between the aperture plate 11*a* and the cavity wall 11*c* is one quarter wavelength, that being the criterion for resonance at the center frequency of operation.

In the particular design according to the invention, the length of the spiral trace of each half of a slot pair was approximately 3.5 wavelengths, this providing relatively large bandwidth. Longer slot trajectories would afford still greater bandwidth.

Figure 5:
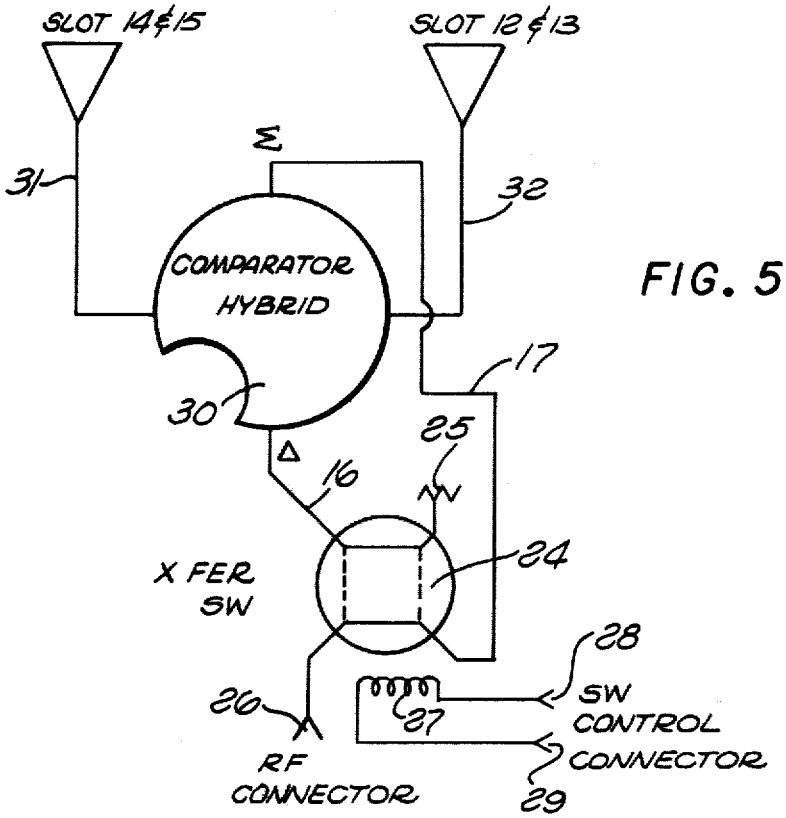
FIG. 5 is a schematic block diagram showing an arrangement for electrical operation of the antenna of the invention to produce sum and difference patterns of circulary polarized radio frequency energy selectably.

In FIG. 2, a switching module 24 is shown, and it is useful to look ahead to FIG. 5 to understand the circuit connections for operation of the antenna of the invention. In FIG. 5, the stripline comparator hybrid 30 is shown with branch ports (outputs) 31 and 32 which feed the slot pair center points via the corresponding balun. Leads 16 and 17 connect to the Δ and Σ ports of hybrid 30 and each feed from a point of the relay (transfer switch) 24. The magnet coil 27 will be understood to respond to energization between terminals 28 and 29 to connect the R F terminal 26 (also visible on FIG. 1) to either 16 or 17. The unused Δ or Σ port of hybrid 30 is switched to a termination 25. The results of this switching will be seen from FIG. 6 in which excitation of the Δ hybrid terminal places a lobe peak on the zero elevation line, and excitation of the Σ hybrid port produces a difference pattern with two lobes and a null on the zero elevation line.

If the antenna were arbitrarily assumed to be mounted into the underbelly of the air/space craft, then the significance of the zero elevation line becomes a line directly downward. The azimuth pattern depicted in FIG. 7 then becomes the beam cross-section in a plane normal to the plane of the pattern of FIG. 6. The elliptical pattern 33 is that resulting from the elliptical outline of the slots in the aperture face 11*a*, as compared to a prior art, typical, circular, spiral radiator depicted at 34 in FIG. 7.

The mathematic relationship for the ellipiticity of the slot pattern of FIG. 1 is given as $\rho(\phi)$ = distance from center of antenna $$\rho(\phi) = \frac{b_o\alpha(\phi - \phi_o)}{\sqrt{\sin^2\phi + (b_o/a_o \cos\phi)^2}}$$

where:

Ao is the ellipse major axis (initially)

bo is the ellipse minor axis (initially)

$\alpha$ is the coefficient of spiraling (pitch)

$\phi$ is the angular distance around antenna then $$\frac{a_o}{b_o} \approx \frac{\sin \Theta_{Bw} \mid \phi = 0^\circ}{\sin \Theta_{Bw} \mid \phi = 90^\circ}$$

where $\theta_{bw}$=desired beamwidth.

It should be noted that the quarter wave cavity depth referred to is a near free space number whereas the quarter wave balun slot to depth 20 is somewhat shortened quarter wave due to the nature of the coaxial medium of the baluns.

The cavity backing the slot radiation structure may be filled with a low-loss dielectric material 18 if the device is to be operated at substantial power and/or high altitude. In that event, the volume of the cavity can be reduced by a factor $1/\sqrt{\epsilon r}$ where $\epsilon r$ is the dielectric constant of 18.

The spiral slot arrangement of FIG. 1 may be referred to as "arrayed cross-slot radiators" which will radiate circularly polarized R.F. energy in the beam patterns described.

The entire apparatus is, of course, reciprocal and accordingly, R.F. terminal 26 can provide received signals as well as accept transmitable energy.

It will be realized by those of skill in this art that stripline instrumentation of the hybrid employed can be replaced by coaxial, waveguide, or some other microwave medium. The particular instrumentation of the hybrid is not per se a part of the invention, although the hybrid is an element of the fully operative confirmation.

The foregoing and other advantages are obvious to those skilled in the art of antennas.

What is claimed is:

1. A cavity-backed, flush-mountable antenna comprising: a conductive-walled cavity of generally elliptical cross-section and having a substantially elliptical aperture plate constituting one face thereof, said cavity being of substantially uniform depth measured normal to said aperture plate; first and second radiator slot pairs cut through the thickness of said aperture plate, the slots of said pairs spiralling in the same rotation sense from corresponding first and second slot center points adjacent on either side of the center of said aperture plate; and slot feed means for separately feeding said first and second slot center points to effect electrically mutually orthogonal operation of said slot pairs.

2. Apparatus according to claim 1 in which said spiralled slots are radially substantially uniformly spaced throughout their spiral trajectories and form an elliptical pattern in said aperture plate.

3. Apparatus according to claim 1 in which said slot feed means comprises first and second coaxial split-tube baluns connected respectively to said first and second slot center points, said baluns extending through said cavity and the wall thereof opposite said aperture plate.

4. Apparatus according to claim 3 including a four port comparator hybrid including two branch ports, one connected to each of said baluns at their ends external to said cavity, said hybrid also including Σ and Δ ports which, when selectively energized, provide discrete sum and difference patterns selectively.

5. Apparatus according to claim 1 in which said cavity is dielectric filled.

6. Apparatus according to claim 3 in which said cavity is dielectric filled, said dielectric surrounding said baluns, the latter extending substantially normal to said aperture plate from said slot center points.

7. Apparatus according to claim 4 in which said hybrid is instrumented in stripline medium, said hybrid being enclosed in a compartment attached to said cavity wall opposite said aperture plate.

8. Apparatus according to claim 1 in which a dielectric cover plate is affixed over the external face of said aperture plate to provide a radome.

9. Apparatus according to claim 7 in which switching means are provided whereby said hybrid Σ and Δ ports may be selectively energized to selectively connect said Σ and Δ ports to common input/output port.

10. Apparatus according to claim 1 in which said slots of each slot pair are a multiple of one wavelength from said slot center points spirally outward.

* * * * *